US006107980A

United States Patent [19]

Hermanns et al.

[11] Patent Number: 6,107,980

[45] Date of Patent: Aug. 22, 2000

[54] CELL CIRCUIT FOR ACTIVE MATRIX LIQUID CRYSTAL DISPLAYS USING HIGH POLARIZATION, ANALOG RESPONSE LIQUID CRYSTALS

[75] Inventors: Anno Hermanns, Fort Belvoir, Va.; Geoffrey L. Barrows, Washington, D.C.; Banhalli R. Ratna, Springfield, Va.

[73] Assignees: Geo-Centers, Inc., Lanham, Md.; The United States of America as represented by the Secretary of the Navy, Washington, D.C.

[21] Appl. No.: 09/031,533

[22] Filed: Feb. 27, 1998

[51] Int. Cl.[7] ..... G09G 3/84

[52] U.S. Cl. ..... 345/90; 345/205

[58] Field of Search ..... 345/90, 92, 205, 345/206, 87, 98, 91

[56] References Cited

U.S. PATENT DOCUMENTS

| | | | |
|---|---|---|---|
| 3,564,135 | 2/1971 | Weimer | 345/90 |
| 3,949,242 | 4/1976 | Hirasawa et al. | 345/92 |
| 4,429,305 | 1/1984 | Hosokowa et al. | 345/92 |
| 5,218,464 | 6/1993 | Hiroki et al. | 345/92 |
| 5,339,090 | 8/1994 | Crossland | 345/205 |
| 5,448,258 | 9/1995 | Edwards | 345/90 |
| 5,627,557 | 5/1997 | Yamaguchi et al. | 345/90 |

*Primary Examiner*—Regina Liang
*Attorney, Agent, or Firm*—Oblon, Spivak, McClelland, Maier & Neustadt, P.C.

[57] ABSTRACT

An active matrix circuit for compact, high resolution reflective liquid crystal displays includes a low quiescent current, low output impedance MOS transistor amplifier produced in a CMOS process. A voltage controlled input switch effects the voltage refresh of the active matrix cell by passing a data voltage to the input of the transistor amplifier when a control voltage pulse is present on the input switch control line. All active matrix cells in a given row use the same input switch control line, and all active matrix cells in a given column access the same data input line. Refresh of the active matrix cell voltage terminates when the input switch is opened, storing the data voltage on the input node capacitance of the amplifier. The active matrix circuit is particularly addressed to liquid crystal devices having fast, analog response liquid crystals with large molecular polarizations such as in the Electroclinic Liquid Crystals (ELC). Including such an amplifier in each active matrix cell facilitates delivery of the large charge required to switch such liquid crystals without incurring a concomitant drop in pixel voltage, as encountered with other active matrix cell circuits.

8 Claims, 4 Drawing Sheets

CELL CIRCUIT FOR ACTIVE MATRIX LIQUID CRYSTAL DISPLAYS USING HIGH POLARIZATION, ANALOG RESPONSE LIQUID CRYSTALS

BACKGROUND OF THE INVENTION

1. Field of the Invention

The present invention is addressed to active matrix circuits for LC devices using fast, analog response liquid crystals with large molecular polarization in order to provide compact, high resolution reflective active matrix liquid crystal devices (AMLCD).

2. Discussion of Background

Circuits used to activate liquid crystal displays feature an active matrix circuit with one or two transistors supplemented by a storage capacitor in order to hold pixel voltage between consecutive frames. These circuits only function correctly for the liquid crystal when the liquid crystal polarization is sufficiently low or if the liquid crystal can be completely switched during one line address time $T_{line}$, defined as $$T_{line} = \frac{\eta_{OH}}{f_R N_{Row} N_{Color}}$$

where $\eta_{OH}$ is an efficiency factor reflecting timing overhead, $f_R$ is the display refresh rate, $N_{Row}$ is the number of display rows, and $N_{Color}$ is the number of colors displayed time sequentially by a given pixel. As an example, a 60 Hz refresh rate, monochrome VGA resolution display has a line address time of approximately 32 microseconds, while a 75 Hz refresh rate SXGA display with three colors displaying time sequentially has a line address of approximately 4 microseconds.

If switching of the LC (liquid crystal) takes longer than one line address time, then the active matrix circuit must supply most of the charge needed to complete switching while at the same time maintaining the stored pixel voltage. Assuming negligible LC conductivity, the required charge is $$Q_{Sw}=2PA,$$

where P is the LC polarization in the switched state and A is the pixel area. In a worst case scenario, the LC switching time is much longer than the line address time. The factor 2 rises when the display is DC balanced by reversing pixel voltage polarity between consecutive frames.

The standard active matrix circuit including a transistor switch and a storage capacitor is not suitable for devices which use liquid crystals with large molecular polarization because, in order to supply $Q_{Sw}$ to the pixel, the storage capacitance $C_{St}$ must exceed the LC pixel capacitance $C_{LC}$ by approximately the number of resolvable gray scales or color shades, $N_{GS}$ wherein:

$$C_{St}=N_{GS}C_{LC}.$$

This is required in order to prevent a reduction in the held pixel voltage by more than the equivalent of one gray scale. For 8 bit gray scale, a sufficiently large storage capacitance cannot be implemented using CMOS processes for fabricating active matrix back panels for reflective microdisplays.

In other types of devices which use twisted nematic liquid crystals (TNLC), the available storage node capacitance is not a limiting factor because the LC polarization is very small. Surface stabilized ferroelectric liquid crystal (SSFLC) devices are likewise unaffected by the limited available storage node capacitance because of their inherently bistable switching. The switched states of SSFLC can be stable even if the storage capacitor voltage drops appreciably while switching is being completed.

However, both types of liquid crystals have significant drawbacks to their use. Typical TNLC have switching times on the order of tens of milliseconds, while the bistable SSFLC can generate uniform and reproducible gray scale only by temporal or spatial multiplexing (sub-pixels). These techniques in turn either raise the response time or increase the pixel area, by a factor equal to the number of resolved gray scales.

Of considerable interest in this area is the development of Electroclinic Liquid Crystals (ELC), also known as Soft Mode FLC, which combines the gray scale response of TNLC with the fast switching of SSFLC. Recently ELC have been synthesized featuring fast switching of approximately 100 microseconds and a gray scale response at low applied fields of a few volts per micrometer. Further they have a high contrast of greater than 500 to 1 and a large depth of modulation because of high tilt angles of up to 30 degrees. Of significance however is the fact that the induced polarizations can reach several hundred $nC/cm^2$ which cannot be operated properly using prior art active matrix cell circuits. Accordingly there is a need for a differently constructed matrix cell circuit to handle the larger induced polarizations.

SUMMARY OF THE INVENTION

Accordingly, it is one object of the present invention to provide an active matrix cell circuit having a voltage controlled input switch and a compact amplifier which provides a charge sufficient to switch the liquid crystal while preventing a decrease of the held pixel voltage due to the switching of a high polarization liquid crystal.

It is another object of the present invention to provide an active matrix cell circuit having an amplifier with a low output impedance to enable fast switching of the high capacitance liquid crystal pixels and a low quiescent current to avoid excessive power dissipation, yet be compact enough to facilitate small pixel pitch.

It is further an object of the present invention to provide an active matrix switch circuit including a switch between the compact amplifier output and the pixel in order to facilitate DC balancing of the liquid crystal and continuous viewing of the display.

These and further objects are accomplished by an active matrix circuit construction featuring a low output impedance amplifier having first and second MOS transistors wherein the drain of the first transistor is connected to a first supply voltage, the source of the second transistor is connected to a second supply voltage (typically ground), and the source of the first transistor and the drain of the second transistor are shared and together form an amplifier output node and wherein the gate of the second transistor is held at a third voltage with the third voltage having a value less then a value of the second transistor threshold voltage and with the gate of said first transistor receiving an input signal wherein an amplifier transfer function of said amplifier is substantially linear and has a slope of less than 1 and an input switch device providing the input signal to the amplifier.

It is a further object to provide an active matrix cell circuit construction having a voltage controlled input switch wherein said input switches of all active matrix cells in a given row are actuated by a voltage pulse on their shared input switch control line and wherein all active matrix cells in a given column access a common data input line. The voltage controlled input switch passes the column data voltage to the input of a MOS transistor amplifier having a low quiescent current and low output impedance whereby all input nodes of said amplifiers in a given row of said active matrix cells are updated synchronously with their respective data line voltages and wherein the quiescent current and the amplifier response speed can be tuned by a single global bias voltage which is shared between all active matrix cells and which is adjustable to compensate for operating temperature and fabrication process variations of the circuit. An output switch connects the amplifier output and the liquid crystal pixel to facilitate DC balanced addressing and continuous display readout of said liquid crystal pixel. The control voltage of the output switch is globally shared between all active matrix cells.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
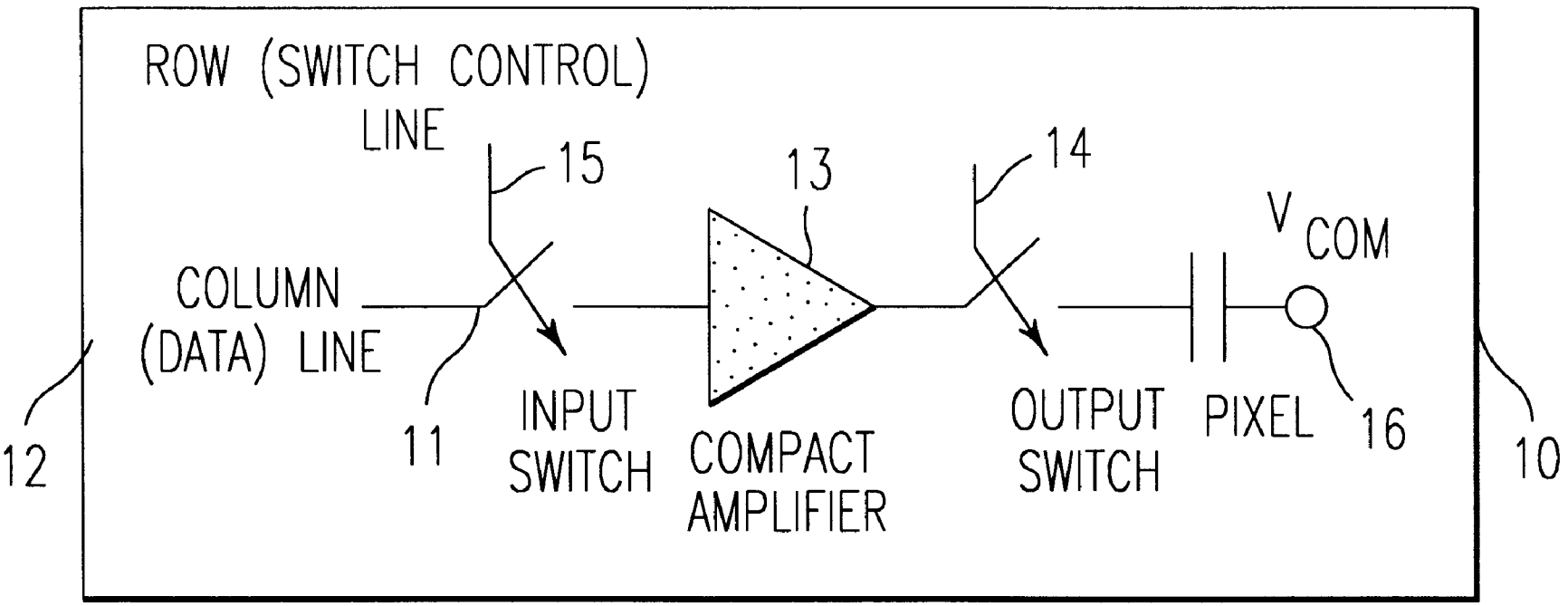
FIG. 1 is a schematic of the active matrix circuit of the present invention.

Referring now to the drawings, wherein like reference numerals designate identical or corresponding parts throughout the several views, and more particularly to FIG. 1 thereof, the active matrix cell circuit 10 includes a voltage controlled input switch 11 for connection of the data line 12 to compact amplifier 13. An output of the compact amplifier is fed to a voltage controlled output switch 14 in order to provide DC balancing and continuous readout of the display. The input switch control line 15 is shared between all active matrix cells in a particular row and all the cells in a given column access the same data input line. Voltages for all the cells in a given row are refreshed simultaneously, initiated by a voltage pulse on the appropriate row line 15. This voltage on the row line 15 closes the input switch 11 of every cell in that particular row and passes appropriate data voltage to the input of the compact-high speed-low quiescent current amplifier 13. The refresh is terminated by opening the input switch 11, which stores data voltage on the input node capacitance of the amplifier.

The purpose of the amplifier is to provide a sufficiently large charge as is required to switch the liquid crystal while preventing a decrease of held pixel voltage caused by the switching of the high polarization liquid crystal.

In order to function for reflective microdisplays derived from silicon chips having both active matrix and display drivers, the size of the active matrix cell circuit 10 must be as small as possible in order to keep the display affordable and feasible. The compact amplifier 13 has a low output impedance to enable fast switching of the high capacitance liquid crystal pixels 16 and a low quiescent current to avoid excessive power dissipation by the active matrix, yet is compact enough to facilitate a small pixel pitch. The output switch 14 may be required between the amplifier output and the pixel in order to facilitate DC balancing of the liquid crystal and continuous viewing of the display.

Figure 2:
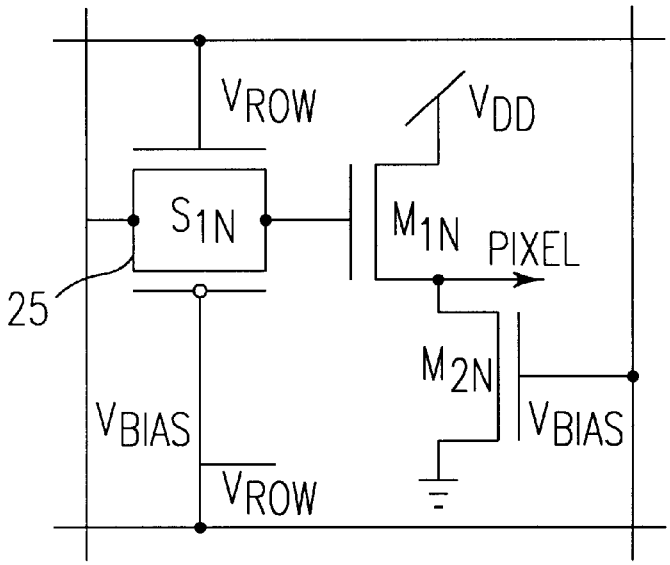
FIG. 2 is an exemplary embodiment of the compact amplifier of FIG. 1 using NMOS amplifier construction.
Figure 3:
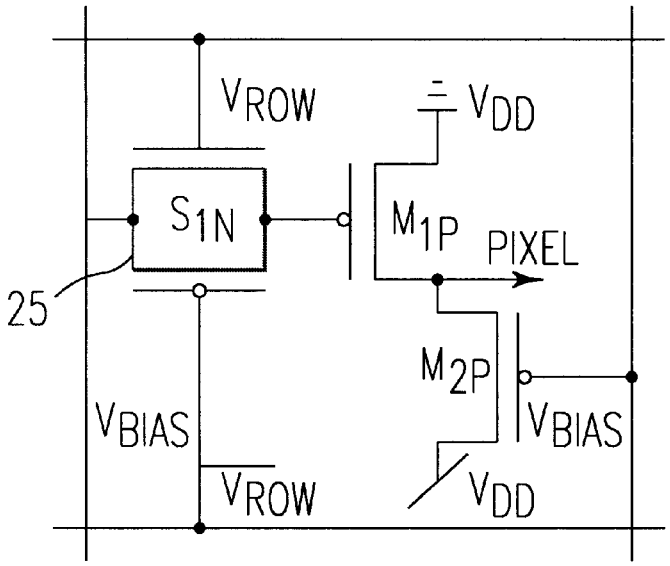
FIG. 3 is a diagram of the compact amplifier of FIG. 1 using a PMOS amplifier construction.
Figure 4:
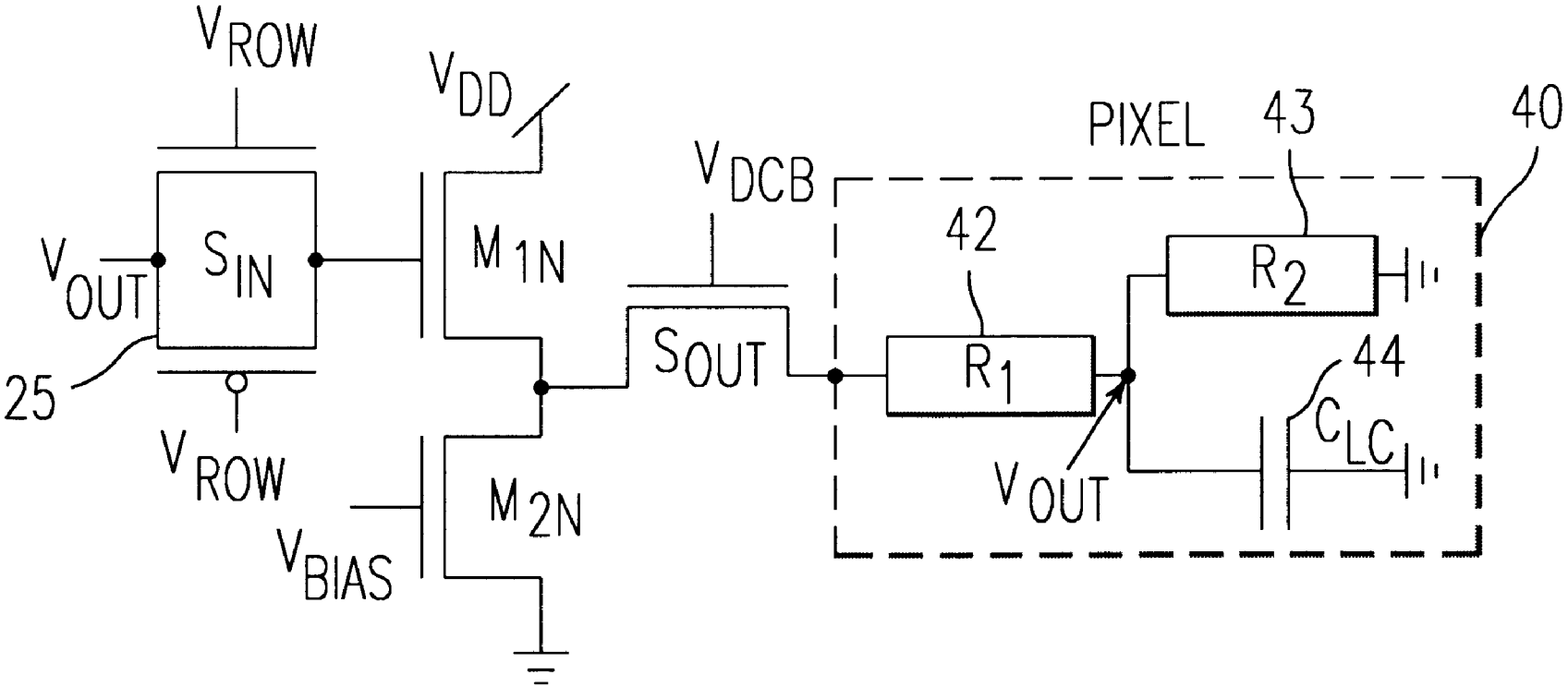
FIG. 4 is a diagram of an active matrix circuit construction including an equivalent circuit for the liquid crystal pixel.

The voltage controlled input switch may be formed by a single transistor or by a pass gate 25 as shown in the FIGS. 2–4 and labeled as $S_{in}$. The pass gate 25 consists of a NMOS transistor and parallel to a PMOS transistor. Whereas a single transistor saves layout space and requires only one switch control voltage, its main disadvantage is that because of the back gate effect, it can only pass voltages up to $V_{SC}-V_T$ where $V_{SC}$ is the switch control voltage and $V_T$ is the transistor threshold voltage. In contrast, a pass gate such as 25 can pass any voltage up to the switch control voltage $V_{SC}$. However, adding a transistor of the complementary type in order to increase the voltage that can be passed to the amplifier requires an additional switch control voltage line as well as additional layout area.

The compact amplifier 13 may be constructed as in either of the embodiments of FIG. 2 or FIG. 3. In the embodiment of FIG. 2 the compact amplifier is formed of an NMOS transistor pair $M_{1N}$ and $M_{2N}$ which is accomplished by a standard 5 volt CMOS process. $M_{1N}$ has its drain connected to $V_{DD}$ and $M_{2N}$ has its source connected to $V_{SS}$ which is usually ground. The source of $M_{1N}$ and drain of $M_{2N}$ are shared and form the amplifier output node. The gate of the $M_{2N}$ transistor is held at a global bias voltage $V_{Bias}$ which is set below the NMOS transistor thresh old voltage $V_{TN}$. The gate of the $M_{1N}$ transistor is connected to the active matrix cell input switch 25 ($S_{1N}$) and holds the pixel address voltage. The output voltage of the amplifier 13 is limited by the back gate effect to at most the upper supply voltage minus the NMOS threshold voltage, $V_{DD}-V_{TN}$ ($V_{TN}>0$). Therefore the amplifier transfer function, while nearly perfectly linear, has a slope of less than 1.

The alternate embodiment for the compact amplifier 13 as detailed in FIG. 3 is formed by a PMOS transistor pair $M_{1P}$ and $M_{2P}$ in a standard 5 volt CMOS process. The $M_{2P}$ transistor has its drain connected to $V_{DD}$ and the $M_{1P}$ transistor has its source connected to $V_{SS}$ (usually ground). The source of the $M_{2P}$ transistor and the drain of the $M_{1P}$ transistor are shared and form the amplifier output node. The gate of the $M_{2P}$ transistor is held at a global bias voltage $V_{Bias}$ which is set above the PMOS transistor turn-on voltage given by $V_{DD}+V_{TP}$ where $V_{TP}$ is the PMOS threshold voltage ($V_{TP}<0$). The gate of the transistor $M_{2P}$ is connected to the active matrix cell input switch 25 and holds the pixel address voltage. The output voltage of the amplifier is limited by the back gate effect to at least the lower supply voltage plus the PMOS threshold voltage, $V_{SS}-V_{TP}$. Therefore this amplifier transfer function, which is again substantially linear, also has a slope with magnitude less than 1.

The compact amplifiers 13 of either the NMOS type construction of FIG. 2 or the PMOS type construction of FIG. 3 can also be implemented in high resolution, high voltage CMOS processes, for example using a lightly doped drain (LDD) process with only moderate increase in cost. This high voltage CMOS process further increases the voltage which can be applied to a liquid crystal pixel and thus increases the brightness and contrast of the display.

The active matrix cell output switch 14 can consist of a single transistor $S_{Out}$ as shown in FIG. 4 which is of the same type as the amplifier transistors. The reduction of the amplifier output voltage due to the back gate effect means that no further voltage is lost as the output voltage is passed through the single transistor output switch 14. The output switch, which may be activated with a single global switch voltage, makes it possible to update all active matrix cells without affecting the gray scale values displayed by the pixels and then to use the dead time between successive frames to update all liquid crystal pixels simultaneously.

Figures 5A, 5B:
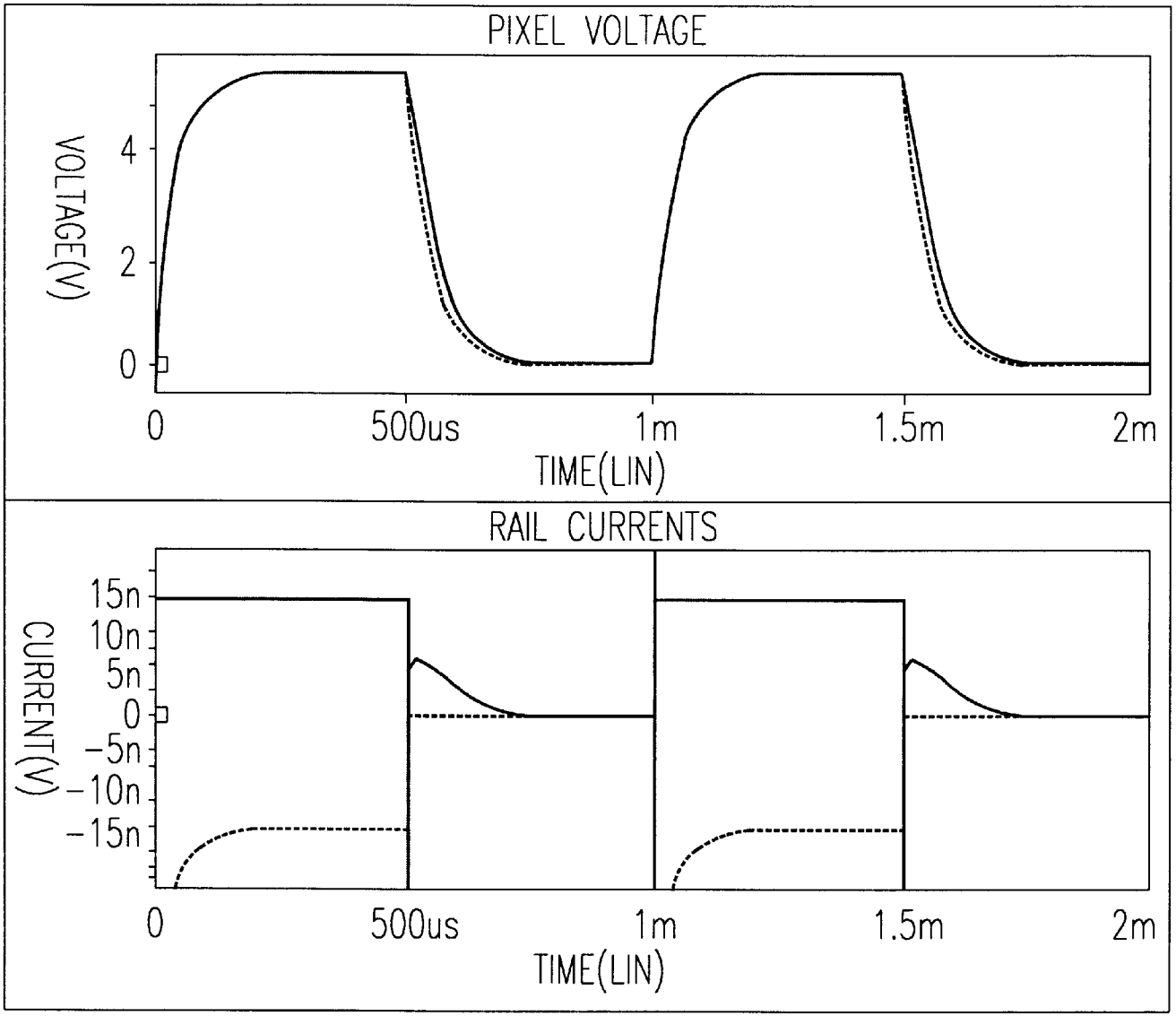
FIG. 5 illustrates circuit simulations for various conditions of the circuit of FIG. 1.

FIG. 5 illustrates simulations in the operation of the circuit 10 which shows that both changes in the operating temperature of the circuit and typical fabrication process variations can be compensated by adjusting the global bias voltage. The simulation of both scenarios involved the bias voltage being adjusted to restore a fixed quiescent current because the quiescent current determines both the steady state power consumption and the output impedance of the amplifier and therefore the switching speed of the pixels. Subsequent to this adjustment, the amplifier output voltage swing was only slightly affected by the simulated process variations and was unaffected by the changes in the operating temperature. More particularly, the simulation output illustrated in FIG. 5 resulted from an operation with the input switch closed and applied input pulses with 7V amplitude and 0.5 second duration and 0.5 second interval. As a result FIG. 5A shows a resulting voltage drop across a pixel driven by the amplifier as shown in the solid line and by an ideal voltage source as shown by the dash line which reflects the limits imposed by the liquid crystal response. In FIG. 5B, there is an illustration of the supply currents drawn by the amplifier using simulation parameters of $V_{DD}$=7 volts, $V_{SS}$=0 volts and $V_{Bias}$=0.8 volts. All transistors were minimized in size according to CMOS design rules with L being equal to 1.2 microns, W being equal to 2.4 microns with the exception of the load transistor $M_{2N}$ which was sized at L equals 2.4 microns and W equals 2.4 microns.

This FIG. 5 shows that the steady current drawn by each amplifier is 14 nA which gives a steady state power consumption for a VGA size (480×640) active matrix of such circuits of 30 mW. Changing the bias voltage allows lower amplifier output impedance and consequently faster switching at the expense of an increased power consumption.

Even though pixel charging and discharging are asymmetric due to the amplifier architecture, the time required for the pixel voltage to approach its target value to within one gray scale is only 10 percent longer than the limit imposed by the liquid crystal material response for both charging and discharging.

The FIG. 5 is an example of a circuit simulation setup wherein the pixel size is assumed to be 20 microns×20 microns, the LC layer thickness was 2 microns, the LC polarization was 200 nC/$cm_2$ at 4V/microns, the LC switching time (10% to 90%) was 100 microseconds, the LC resistivity was $10^{10}$ ohm-cm. The liquid crystal pixel was simulated using an equivalent RC circuit 40 as shown in FIG. 4. Three elements were required to represent the observable pixel capacitance, LC switching time and DC pixel resistance. The parameters for the three elements 42, 43 and 44 for the equivalent RC circuit, as calculated from the measured observation, include R1=455 M ohms, R2=499.5 G ohms, and $C_{LC}$=100 fF.

The active circuit of the present invention, generally shown in FIG. 1 and detailed in the FIGS. 2–4, allows for a switching of high speed analog response liquid crystals with large polarizations without affecting the stored pixel voltage. Because of its small size (less than 23 micron pitch in 1.2 micron CMOS technology), the circuit is suitable for a very high resolution compact reflective liquid crystal display. A single global control voltage (the bias voltage $V_{Bias}$) allows setting the display power dissipation and switching speed. It also permits compensating changes in operating temperature and the inevitable run-to-run variations in transistor properties as implemented by a given CMOS fabrication line.

As alternatives, more complex amplifier circuits with a voltage swing closer to the supply voltages and/or non-volatile pixel voltage storage are possible, however, these circuits have higher transistor numbers which thereby increases the pixel size. This in turn requires, for the same resolution display, a larger size silicon chip to hold the display drivers and the active matrix, with drastic increases in per-chip cost, higher cost of the optics needed to view the display, and lower yield per chip. One strategy for avoiding the larger layout area consumed by more complex amplifiers is to use higher resolution standard CMOS processes (0.8 microns or 0.5 microns). However, the maximum supply voltages available in these processes are not sufficient to drive high speed, high polarization electroclinic liquid crystals over the full 45 degree tilt angle range required for full brightness and contrast. Lastly, the standard active matrix circuit could be fabricated using advanced DRAM processes which use exotic dielectrics to make compact, large capacitors. However, such processes are dedicated to memory chip mass production and are not available as a publicly accessible fabrication service.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An active matrix circuit for activating a liquid crystal display, comprising:

a low output impedance amplifier having first and second MOS transistors each having a drain, source and gate wherein the drain of said first transistor is connected to a first supply voltage and the source of said second transistor is connected to a second supply voltage, and wherein the source of said first transistor and the drain of said second transistor are shared and together form an amplifier output node, and wherein the gate of said second transistor is connected to a third voltage having a value such that said second transistor is operated below threshold and wherein adjustments of said third voltage compensate for changes in operating temperature and for fabrication process variations of said active matrix circuit, and wherein the gate of said first transistor receives an input signal wherein an amplifier transfer function of said amplifier is substantially linear; and an input switch device providing said input signal to said first transistor of said amplifier.

2. The circuit according to claim 1, wherein said input switch device includes a voltage controlled input switch for controlling refresh of voltage on cells of said liquid crystal display and wherein said input switch stores data voltage on an input node capacitance of said amplifier.

3. The circuit according to claim 2, further including a single transistor output switch actuated with a single global switch voltage whereby said switch, when open, permits update of the output voltage of said amplifier without effecting the gray scale value displayed by the liquid crystal pixel, and wherein said output switch, when closed, provides synchronous update of all said liquid crystal pixels.

4. The circuit according to claim 1, wherein said first and second transistors are NMOS transistors and wherein said first transistor has its drain connected to a supply voltage $V_{DD}$ and said second transistor has its source connected to a source voltage $V_{SS}$, and wherein an output voltage of said amplifier is restricted to at most said supply voltage $V_{DD}$ minus an NMOS threshold voltage.

5. The circuit according to claim 1, wherein said first and second transistors are PMOS transistors and wherein said second transistor has its source connected to a supply voltage $V_{DD}$ and said first transistor has its drain connected to a supply voltage $V_{SS}$, and wherein an output voltage of said amplifier is restricted to at least said supply voltage $V_{SS}$ minus a PMOS threshold voltage wherein said PMOS threshold voltage is less than zero.

6. The circuit according to claim 1, wherein said input switch device being voltage controlled and being formed by a passage of an NMOS transistor in parallel with a PMOS transistor wherein said passage passes any voltage equal to or less than a switch control voltage of said input switch.

7. An active matrix liquid crystal display circuit, comprising:

a voltage controlled input switch wherein said switch is actuated by a voltage pulse on a control line shared between all said voltage controlled input switches in a given row of active matrix cells, and wherein all cells in a given column of said active matrix access a shared data input line and wherein said cell is updated with the voltage present on said column data line when receiving a voltage pulse on said row control line;

a low output impedance, low quiescent current amplifer having an input connected to said input switch;

an output switch directly connecting an output of said amplifier to a liquid crystal pixel, wherein said output switch facilitates DC balanced addressing of said liquid crystal pixel as well as continuous display readout of said liquid crystal pixel and wherein said output switch is actuated by a single global switch voltage shared by all said output switches in said active matrix.

8. An active matrix liquid crystal display circuit, comprising:

means for activating a given row of active matrix cells with a voltage pulse on a control line shared between voltage controlled input switches in a given row of said active matrix cells, wherein cell in a given column of said active matrix access a shared data line input and wherein said cell is updated with a voltage present on said column data line when receiving a voltage pulse on said row control line;

means for amplifying an output of said means for activating, said means for amplifying including means for providing a low output impedance and means for maintaining a low quiescence current state; and switching means for directly connecting an output of said for amplifying to a liquid crystal pixel including means for facilitating DC balanced addressing of said liquid crystal pixel as well as continuous display readout of said liquid crystal pixel and being actuated by a single global switch voltage shared by all switching means in said active matrix.

* * * * *